United States Patent [19]

Glickson

[11] 4,288,071

[45] Sep. 8, 1981

[54] PNEUMATIC SEESAW APPARATUS

[75] Inventor: David A. Glickson, Chicago, Ill.

[73] Assignee: Marvin Glass & Associates, Chicago, Ill.

[21] Appl. No.: 106,281

[22] Filed: Dec. 21, 1979

[51] Int. Cl.[3] ..... A63G 31/00

[52] U.S. Cl. ..... 272/1 R; 272/130

[58] Field of Search ..... 272/1 R, 1 B, DIG. 1, 272/54, 55, 56, 130, 116, 125, 93, 114; 9/2 A, 11 A, 301, 310 F, 310 J, 311, 348; 5/449; 46/44, 87, 88, 89, 90

[56] References Cited

U.S. PATENT DOCUMENTS

| | | | |
|---|---|---|---|
| 461,956 | 10/1891 | Galibert | 9/311 |
| 1,058,402 | 4/1913 | Ayvad | 9/311 |
| 1,885,606 | 11/1932 | Kimmel | 9/311 |
| 2,013,410 | 9/1935 | Howland | 272/1 B |
| 2,068,061 | 1/1937 | May | 46/90 UX |
| 2,487,546 | 11/1949 | Harrowe | 46/88 |
| 2,546,396 | 3/1951 | Jenkins | 9/2 A X |
| 3,578,318 | 5/1971 | Young | 272/1 R |
| 3,658,326 | 4/1972 | Fawick | 272/130 X |

FOREIGN PATENT DOCUMENTS

| | | | |
|---|---|---|---|
| 2236525 | 2/1975 | France | 272/1 R |

*Primary Examiner*—Richard C. Pinkham
*Assistant Examiner*—Arnold W. Kramer
*Attorney, Agent, or Firm*—Mason, Kolehmainen, Rathburn & Wyss

[57] ABSTRACT

An elongated unitary inflatable vessel of thin, flexible sheet material includes a pair of relatively large volume, generally circular-shaped, hollow seats at opposite ends interconnected by an integrally formed central conduit of relatively smaller transverse cross-section. Each seat includes an upper seating surface for supporting a person in an elevated position above the floor and the person on one seat may force the seating surface downwardly toward the floor thereby moving air from the seat into the conduit to raise the elevation of the opposite seat and provide a seesaw action.

10 Claims, 3 Drawing Figures

PNEUMATIC SEESAW APPARATUS

BACKGROUND OF THE INVENTION

1. Field of the Invention

The present invention relates to pneumatic seesaw apparatus and more particularly to pneumatic amusement devices particularly well suited for use by young children and the like.

2. Description of the Prior Art

Teeter-totters or seesaws have long been popular with young children and air inflatable devices including large figure toys or beach toys, have been increasingly popular as the manufacture of thin, flexible plastic films or sheet material has been developed. U.S. Pat. Nos. 3,578,318; 3,836,141; 3,884,463 and 3,997,157 disclose pneumatic amusement and seesaw type devices and games that have been provided heretofore.

OBJECTS OF THE PRESENT INVENTION

It is an object of the present invention to provide a new and improved pneumatic seesaw or teeter-totter for use by young children and the like.

Another object of the invention is to provide a new and improved pneumatic amusement device which is light in weight, readily collapsible and inflatable with air and which provides education, exercise and amusement for one or more persons such as young children.

Still another object of the present invention is to provide a new and improved pneumatic seesaw apparatus designed for use by young children to improve motor skills and at the same time, provide social interaction between two young children playing together.

Yet another object of the present invention is to provide a new and improved pneumatic seesaw device which is easily stored away and requires little storage space when not in use and which is easily inflated into an enlarged condition, ready for use.

Still another object of the present invention is to provide a new and improved pneumatic seesaw apparatus having a unique and pleasing design appearance without sharp edges or corners so that the likelihood of injury during handling or play with the apparatus is minimized.

SUMMARY OF THE INVENTION

The foregoing and other objects and advantages of the present invention are accomplished in a new and improved pneumatic seesaw comprising an elongated, hollow, unitary, air-tight pressure vessel formed of thin, flexible, plastic film or sheet material and adapted to contain a volume of air under pressure. The seesaw apparatus includes a pair of relatively large volume, generally circular-shaped, hollow seats at opposite ends interconnected by an integral, centrally disposed, hollow tubular conduit with an internal volume substantially less than that of the circular-shaped seat and having a transverse dimension and cross-sectional area substantially less than that of the seats. Each seat includes an upper seating surface for supporting a person such as a child in an elevated position above the floor and the child on one seat may force the upper seating surface downwardly towards the floor thereby to move air from the seat into the conduit for elevating the child on the opposite seat and vice versa.

BRIEF DESCRIPTION OF THE DRAWINGS

For a better understanding of the invention, reference should be had to the following detailed description taken in conjunction with the drawings, in which.

DESCRIPTION OF THE PREFERRED EMBODIMENT

Figure 1:
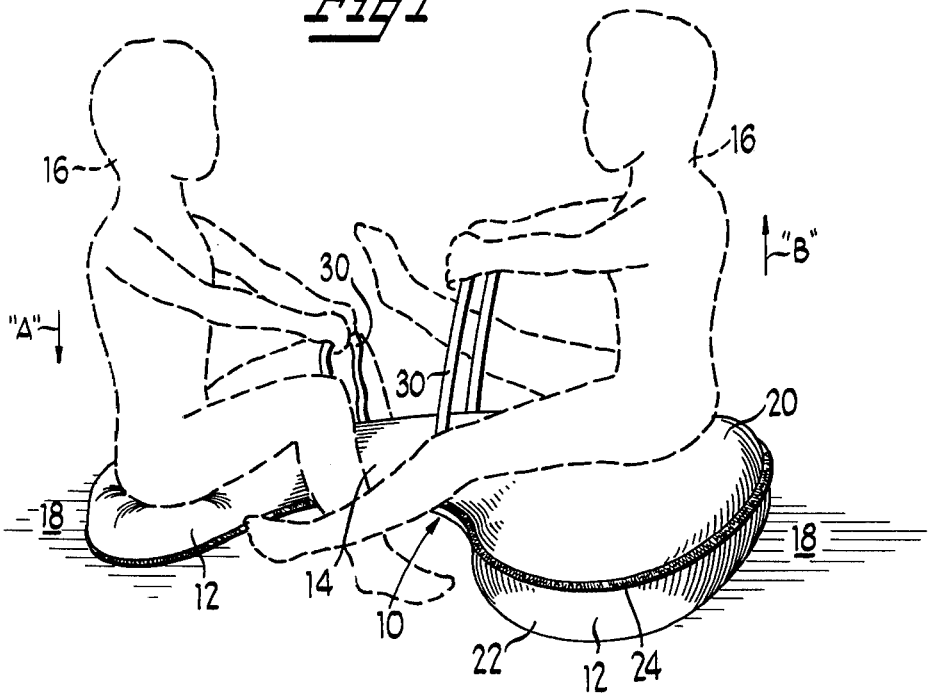
FIG. 1 is a perspective view of a new and improved pneumatic seesaw apparatus constructed in accordance with the features of the present invention and illustrated as it is in use by two young children.
Figure 2:
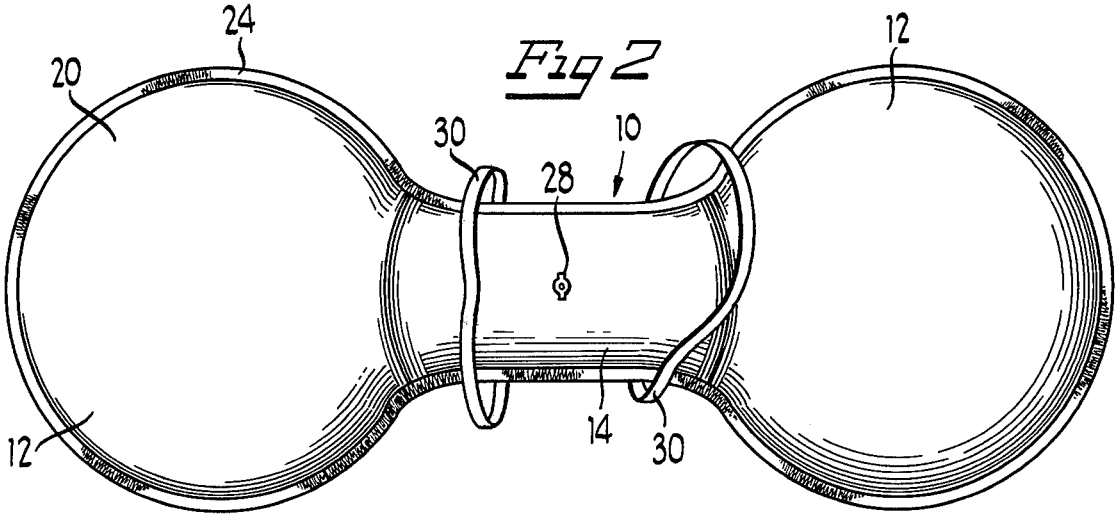
FIG. 2 is a top plan view of the apparatus of FIG. 1.

Referring now more particularly to the drawings, therein is illustrated a new and improved pneumatic seesaw apparatus or teeter-totter constructed in accordance with the features of the present invention and referred to generally by the reference numeral 10. Generally, the seesaw apparatus is formed in the shape of a large dog bone or flattened dumbbell and includes a pair of relatively large volume, generally circular-shaped seats 12 at opposite ends and internally interconnected with each other through a relatively narrow, elongated central conduit portion 14. Each seat 12 is adapted to support a person such as a young child 16 in sitting position above the surface of a floor 18 or other surface.

Figure 3:
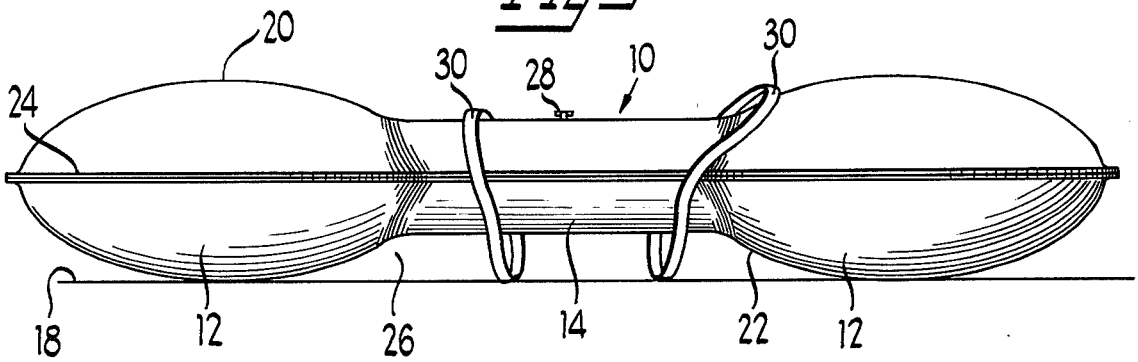
FIG. 3 is a side elevational view of the apparatus.

As illustrated, the pneumatic seesaw is generally dumbbell shaped and is formed by an upper piece of thin, flat, flexible, resilient, plastic film or sheet material 20 and a similar shaped lower piece 22. The upper and lower pieces are joined together by heat sealing in a seam 24 extending around the peripheral edge and the seam is positioned at a mid level of the seesaw when inflated with air as shown in FIG. 3. The peripheral, heat sealed seam 24 provides a degree of rigidity and strength for the apparatus when inflated. The upper and lower halves are initially made of patterns cut out from flat stock or sheets such as thin, strong, polyvinyl chloride film or the like. The upper and lower patterns 20 and 22 are gathered together around the peripheral edges at the seam 24 when the heat sealing process takes place so that the generally cylindrical-shaped seats 12 take the profile of an ellipse when viewed in vertical cross-section when inflated as shown in FIG. 3.

The interconnecting, intermediate, conduit portion 14 is of a similar, but smaller elliptically-shaped, transverse cross-section, and the underside of the central conduit portion is normally spaced above the floor surface 18 providing an open space 26 as illustrated. An air valve mechanism 28 is provided on the upper half 20 of the apparatus along the center of the conduit portion 14 and the mechanism is of the type adapted to accommodate either a mechanical air pump or permit a person to blow into a valve stem to inflate the apparatus 10 by lung power. The air valve mechanism includes a removable stopper which is used to close off the valve stem after inflation and the stopper is removable to permit the air in the apparatus to rapidly escape so that the seesaw may be flattened out after complete deflation. When the apparatus is in a flattened out, deflated condition, very little space is required for storage when the apparatus is not being used.

The seesaw apparatus includes a pair of handles in the form of loops 30 formed of elongated strips of strong, thin, flexible material and each is looped around the narrow central conduit portion 14 so that an upper portion may be conveniently grasped by a child 16 sitting on a seat portion.

In operation, a volume of air under pressure inside the inflatable seesaw apparatus is selected to have a pressure sufficient to support a child in sitting position on each of the seats 12 at a level elevated above the floor surface 18. In order to seesaw up and down, one child places his feet on the floor and lifts his body upwardly to release the weight exerted on the seat below. When this occurs, some of the volume of air in the other seat and conduit moves in to raise the upper surface of the seat and then the child permits his body to move downwardly onto the seat with force as indicated by the arrow "A". Some of the air in the seat beneath this child is then forced into the conduit section 14 and the upper surface on the opposite seat raises causing the child thereon to be raised as indicated by the arrow "B". The seesaw process is then repeated in reverse and two children may thus act to achieve a seesaw action back and forth as the air volume within the apparatus 10 is displaced back and forth between the seats 12 at opposite ends to raise and lower the respective seats under the children on the seesaw. Sufficient air pressure is introduced into the inflatable apparatus before play is commenced so that the upper half 20 of the seats 12 does not tend to bottom out against the floor 18 during normal play. When heavier children use the apparatus, the inflating air pressure is, of course, increased and with lighter or smaller children, the air pressure may be decreased somewhat. The straps 30 are loosely connected about the intermediate conduit portion 14 and provide a convenient means for holding on during the seesaw action.

The pneumatic seesaw apparatus 10 is useful in developing motor skills of young children and can serve as a source of amusement during long hours of play and social interaction between two or more young children.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. Pneumatic seesaw apparatus, comprising: an elongated, hollow, unitary, air-tight, flexible vessel formed of two thin flexible sheets of material of substantially uniform thickness, said sheets joined along their edges and said vessel inflatable to contain a volume of gas under pressure and collapsible to flattened configuration when uninflated;

said vessel including a pair of relatively large volume, generally circular-shaped, hollow seats, at opposite ends and interconnected by an integrally formed, centrally disposed hollow tubular conduit portion having an internal volume substantially less than said circular-shaped seats and a transverse dimension substantially less than the diameter of said seats at the end, said circular-shaped seats having a diameter greater than their transverse dimension; and each seat including an upper seating surface for supporting a person in an elevated position above a lower wall portion in contact with a floor or support, whereby a person on one seat may force said upper seating surface downwardly toward said floor to move air from said one seat into said conduit for elevating the upper seating surface of the opposite seat for raising another person sitting thereon.

2. The apparatus of claim 1 including valve means for inflating and deflating said seats and conduit.

3. The apparatus of claim 2 wherein said valve means is positioned on said conduit portion.

4. The apparatus of claim 1 formed of a pair of pieces of plastic film joined together around a peripheral seam and forming upper and lower wall portions.

5. The apparatus of claim 4 wherein said seam is formed by heat sealing.

6. The apparatus of claim 5 wherein said seam is formed by gathered edges of said film around the peripheries of said upper and lower wall portions whereby said seats are generally elliptical in transverse vertical cross-section when said vessel is inflated with gas.

7. The apparatus of claim 6 wherein said conduit portion includes an underside spaced above said floor when said vessel is inflated with gas and seats are resting on said floor.

8. The apparatus of claim 7 wherein said conduit portion is generally elliptical in transverse cross-section when said vessel is inflated with gas.

9. The apparatus of claim 1 shaped substantially as a dumbbell with flattened end portions forming said seats when said vessel is inflated with gas.

10. The apparatus of claim 1 including a pair of straps freely encircling said conduit portion to be grasped by persons sitting on said seats.

* * * * *